US009303854B2

(12) United States Patent
Rudisill et al.

(10) Patent No.: US 9,303,854 B2
(45) Date of Patent: Apr. 5, 2016

(54) ELECTRICAL RAIL SYSTEMS WITH AXIALLY INTERLEAVED CONTACT ARRAYS

(71) Applicants: Charles Albert Rudisill, Apex, NC (US); Daniel John Whittle, Bellingham, WA (US)

(72) Inventors: Charles Albert Rudisill, Apex, NC (US); Daniel John Whittle, Bellingham, WA (US)

(73) Assignee: APEX TECHNOLOGIES, INC., Apex, NC (US)

( * ) Notice: Subject to any disclaimer, the term of this patent is extended or adjusted under 35 U.S.C. 154(b) by 144 days.

(21) Appl. No.: 14/205,360

(22) Filed: Mar. 11, 2014

(65) Prior Publication Data

US 2014/0268835 A1 Sep. 18, 2014

Related U.S. Application Data

(60) Provisional application No. 61/777,513, filed on Mar. 12, 2013.

(51) Int. Cl.

| | |
|---|---|
| ***F21V 21/14*** | (2006.01) |
| ***F21V 21/35*** | (2006.01) |
| ***F21V 29/00*** | (2015.01) |
| ***H01B 9/00*** | (2006.01) |
| ***H01R 4/00*** | (2006.01) |
| ***H01R 25/14*** | (2006.01) |
| ***F21V 29/77*** | (2015.01) |

(Continued)

(52) U.S. Cl.

CPC ..... *F21V 21/35* (2013.01); *F21S 8/066* (2013.01); *F21V 21/14* (2013.01); *F21V 29/773* (2015.01); *H01R 25/14* (2013.01); *F21S 8/061* (2013.01); *F21Y 2101/02* (2013.01)

(58) Field of Classification Search

CPC ..... H01R 25/14; F21S 8/061; F21V 21/14

See application file for complete search history.

(56) References Cited

U.S. PATENT DOCUMENTS

| | | | |
|---|---|---|---|
| 3,647,994 | A | 3/1972 | Vozenilek |
| 3,677,867 | A | 7/1972 | Westlund |
| 4,751,627 | A | 6/1988 | Usher |

(Continued)

FOREIGN PATENT DOCUMENTS

| | | | |
|---|---|---|---|
| DE | 1204731 | B | 11/1965 |
| DE | 3811740 | A1 | 10/1989 |

(Continued)

*Primary Examiner* — Jong-Suk (James) Lee

*Assistant Examiner* — Eric T Eide

(74) *Attorney, Agent, or Firm* — Patent Leverage LLC; Daniel J. Whittle

(57) ABSTRACT

An improved electrical rail system for removable and repositionable lighting or other electrical fixtures is disclosed in which electrical interface contacts are interleaved along the rail axis to provide a wide range of fixture pivoting angles around the axis and linear translation along the axis of the rail assembly. Track systems disclosed include linear electrode rails with substantially circumferential contacts configured to provide pivoting of luminaires around the rail in excess of 180 degrees to provide lighting fixture directional flexibility. Helical rail systems are also disclosed with a plurality of interleaved electrical contacts on the surface that coil around the axis of the rail providing continuous pivoting of fixtures. Embodiments include rails with axial symmetry that may be bent in directions perpendicular to the rail axis. Embodiments provide fixture functional switching through movement in a first direction followed by further movement of the fixture without functional switching.

25 Claims, 13 Drawing Sheets

(51) Int. Cl.
*F21S 8/06* (2006.01)
*F21Y 101/02* (2006.01)

(56) References Cited

U.S. PATENT DOCUMENTS

| | | | | |
|---|---|---|---|---|
| 4,861,273 | A | | 8/1989 | Wenman et al. |
| 4,979,081 | A | | 12/1990 | Leach et al. |
| 5,027,262 | A | | 6/1991 | Freed |
| 5,158,360 | A | | 10/1992 | Banke |
| 5,207,589 | A | | 5/1993 | Lettenmayer |
| 5,351,620 | A | * | 10/1994 | Becheau ..... F21V 21/34 104/106 |
| 5,833,358 | A | | 11/1998 | Patik |
| 6,132,063 | A | | 10/2000 | Byers |
| 6,135,615 | A | | 10/2000 | Lee |
| 6,170,967 | B1 | | 1/2001 | Usher et al. |
| 6,244,733 | B1 | | 6/2001 | Fong et al. |
| 6,394,626 | B1 | | 5/2002 | McColloch |
| 6,540,372 | B2 | | 4/2003 | Joseph |
| 7,092,257 | B2 | | 8/2006 | Westerheide |
| 7,137,727 | B2 | | 11/2006 | Joseph et al. |
| 7,172,332 | B2 | | 2/2007 | Mobarak et al. |
| 7,311,423 | B2 | | 12/2007 | Frecska et al. |
| 7,507,005 | B1 | | 3/2009 | Mier-Langner |
| 7,677,914 | B2 | | 3/2010 | Nall et al. |
| 7,712,926 | B2 | | 5/2010 | Matheson |
| 7,726,974 | B2 | | 6/2010 | Shah et al. |
| 7,806,557 | B2 | | 10/2010 | Liu et al. |
| 7,806,569 | B2 | | 10/2010 | Sanroma et al. |
| 8,184,445 | B2 | | 5/2012 | Jacobs et al. |
| 2003/0031018 | A1 | | 2/2003 | Bray et al. |
| 2005/0281030 | A1 | | 12/2005 | Leong et al. |
| 2010/0164409 | A1 | | 7/2010 | Lo et al. |
| 2010/0271834 | A1 | | 10/2010 | Muessli |
| 2012/0075871 | A1 | | 3/2012 | Chen |
| 2012/0208378 | A1 | | 8/2012 | Rudisill et al. |
| 2013/0044501 | A1 | | 2/2013 | Rudisill et al. |

FOREIGN PATENT DOCUMENTS

| | | | |
|---|---|---|---|
| DE | 8904398 | U1 | 8/1990 |
| EP | 0404979 | B1 | 9/1996 |
| EP | 0734108 | A2 | 9/1996 |
| EP | 1733653 | A2 | 12/2006 |
| FR | 2082172 | A5 | 12/1971 |
| FR | 2962878 | A1 | 1/2012 |
| JP | 200453328 | A | 9/2005 |
| WO | WO9105378 | A1 | 4/1991 |

* cited by examiner (SECTION A-A OF FIG. 2)

(SECTION B-B OF FIG. 3)

21
23
20

18
19
23
22
23
22
23
22
23
22
23
22
23
22
23
22
23
22
22
18
S
P
P
S 24
26
27
25

A
25
27
26

24
s
P
A (SECTION A-A OF FIG. 11)

(END-VIEW OF FIG. 15)

(SECTION C-C OF FIG. 15)

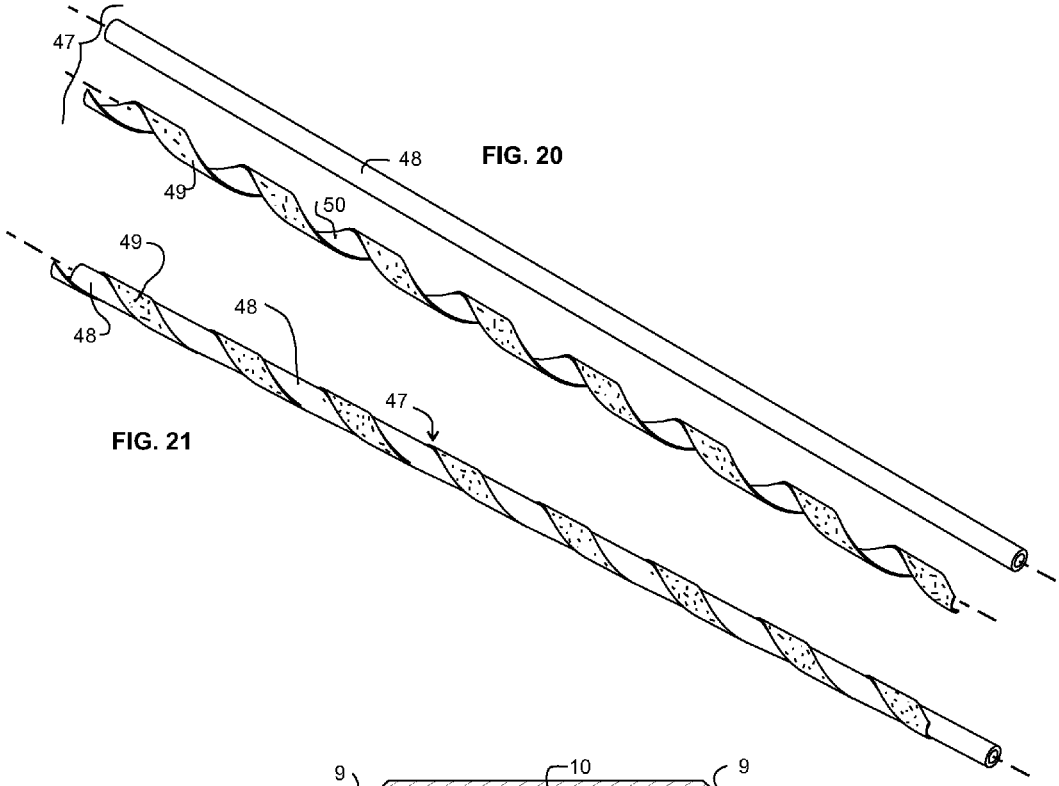
FIG. 20
FIG. 21
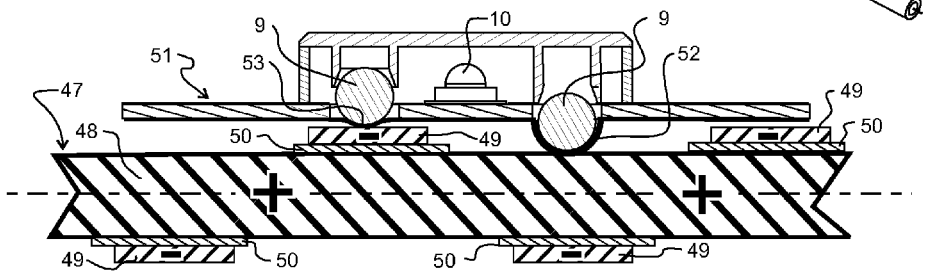
FIG. 22
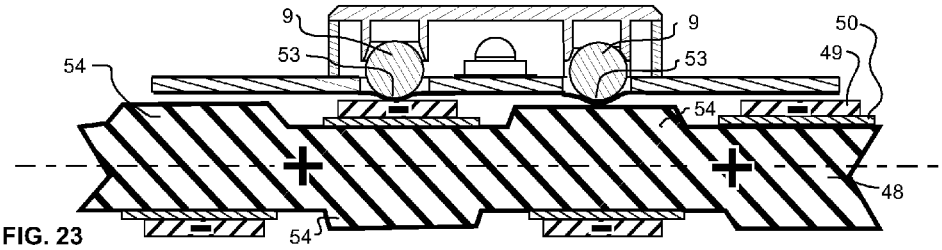
FIG. 23

(SECTION A-A OF FIG. 25)

ELECTRICAL RAIL SYSTEMS WITH AXIALLY INTERLEAVED CONTACT ARRAYS

This application claims priority of U.S. provisional patent application No. 61/777,513 filed on Mar. 12, 2013, which is hereby incorporated by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

FIELD OF THE INVENTION

The present invention relates to electrical distribution systems for removable fixtures. In particular, it relates to electrode track lighting systems with axially interleaved contacts and methods of use.

BACKGROUND OF THE INVENTION

Many varieties of track lighting or rail electrode systems exist. These generally include various designs of spatially separated electrodes that are located parallel to the linear axis of the track. For lighting applications, these "track" or "monorail" systems have at least two continuous parallel electrodes within a mechanical housing, forming a substantially rectangular or prismatic cross-section with continuous electrode contacts along the length of the track. For the purposes of this disclosure, these electrode contact systems are considered to be "axially continuous" contact arrays. That is, a lighting fixture electrical contact remains in an adjacent position to a rail electrical contact as the fixture is translated in a straight line parallel to the axis of the fixed track. Flexible cable type parallel electrode pairs are also another variety of laterally displaced axially continuous rail contact arrays.

Some of these prior art rail are designed to be customized through bending during installation, but are typically difficult to bend in all directions because of their generally rectangular cross section or other asymmetric cross-sectional structure, for example, as shown in representative prior art track cross-sections in FIG. 37 and FIG. 38. The asymmetry of these rails may restrict the ability to practically bend them radially to directions only across the narrow dimension depending upon stiffness. Forming a rail into a closed loop structure may result in undesirable effects from the accumulated difference in path lengths between electrodes on the inside compared to the outside of the bent rail.

While track lighting systems provide more flexibility than stationary lighting fixtures, they do not meet all of the needs for easily configuring the lighting in a space. For example, some fixtures must be disconnected from the rail to reposition them along the rail axis. Also, in order to aim the light output of a lighting fixture attached to prior art electrode systems, additional mechanical knuckle joints, gimbals, or other means are often required to redirect light along different radial directions. These elements increase the weight, size, cost and complexity of the fixtures while still limiting ease of pointing fixtures in space.

BRIEF SUMMARY OF THE INVENTION

The present invention includes systems and methods that address at least one of the one or more of these issues in the prior art. Apparatuses, systems and methods are disclosed herein which relate to systems using axially interleaved contact arrays. In one embodiment, an electrode rail system for removable fixtures comprises first and second electrodes with circumferential contact bands that are supported by an insulating core in an interleaved configuration along the axial direction. In this embodiment, fixtures attached electrically and mechanically to the rail may be rotated about the rail axis by an angle determined largely by the circumferential extent of the bands. Moving the fixture axially results in a transition to a different set of electrical connections. Fixtures may be adapted to change functionality, for example, to change the color or intensity of light emitted from a lighting fixture, through changing electrical connections through motion along or around the rail.

In one embodiment, an electrode rail system comprises axially interleaved contacts comprising a plurality of conductors in the form of non-overlapping helixes on the surface of an insulating core. In this embodiment, pure axial translation along the rail or pure rotation about the axis of the rail provides a sequence of different electrical connection combinations. Translation in a combined axial and rotational motion in sync with the period of the helix will maintain electrical connection through more than a complete rotation. Other embodiments comprise helical structures that are self-supporting without a tubular or solid core.

In one embodiment, fixtures may translate in an axial direction and rotate about the rail axis, but the fixtures after attachment are configured to surround the rail to such an extent that they cannot be removed from the rail through motion perpendicular to the rail axis.

As used herein, the term "axially interleaved rail system" should be interpreted as an electrical rail system comprising a plurality of interleaved contacts associated with at least two electrodes arrayed in a direction parallel to the rail axis. The sizes or shapes of contacts or the space between them, the radial distance of the connection surface of the electrode from the rail axis and the sequence of contacts in an axial direction may be uniform or varied. In axial interleaved contact arrays, electrical contact locations associated with one electrode are interleaved with electrical contact positions associated with at least one other electrode in the axial direction along the exterior surface of the rail. Non-limiting representative examples of rail systems with axially interleaved contacts comprise a series of interleaved contact bands located coaxially outward from the rail axis and a series of interleaved helical contacts extending along the surface of the rail and coaxial with the rail axis.

For purposes of this disclosure, the term "electrical contact" refers to a location for electrical attachment on the outer surface of a rail system. For the purposes of this disclosure, the number of contacts of an electrode can be determined by counting the number of contact surfaces in electrical continuity that lie along a path essentially parallel to the axis of the rail on the outer surface of the contact bands or helixes. With this interpretation, one electrical contact in an axial interleaved rail system should be interpreted to be one circumferential band or one coil of a helical electrode.

The sizes and shapes of contacts, the spaces between them, the radial distance of the connection surface of the electrode from the rail axis and the sequence of contacts in an axial direction may be uniform or varied in a rail system. Contacts and associated electrodes can be held in position relative to one another or mechanically supported by additional structures, or an electrode may provide support for another electrode or contact array.

Tubular shapes in this disclosure are not restricted to circular cross-sections, but may be other relatively long hollow structures having symmetric or asymmetric cross-sections. For asymmetric rail structures, the rail axis should be interpreted as being located at the geometric centroid in the longitudinal dimension. Many of the embodiments are described as cylindrical solid structures or cylindrical tubular structures having circumferential surfaces with cross-sections that are circular arcs. Fixtures are located on the outer surfaces of these tubular structures. Moving a fixture in a circumferential direction on a cylindrical rail system changes the radial orientation of the fixture. When non-cylindrical structures are substituted in these embodiments, the term circumferential should be interpreted to mean the outer perimeter of a cross-section of the structure. The radial orientation of a fixture for non-cylindrical structures can be changed by relocating the fixture to a different surface position on the outer perimeter. For example, in the case of a prismatic structure, moving a fixture from one face to a different face would change the radial orientation as a result of changing the fixture position on the outer perimeter. Similarly, helixes are not restricted to be of the form of cylindrical coils.

For the purposes of this disclosure, the term "rotation about an axis" should be understood to mean changing the radial orientation of an element relative to the axis. The path of a rotating device herein is not restricted to be a circular arc or restricted to a radial plane. In this manner, a fixture may be rotated through an angle about the axis of a prismatic structure by movement between different faces of the prismatic structure, which is a form of circumferential motion, accompanied with an optional translation down the axis.

Some of the embodiments comprise magnetic materials. The properties of magnets are well-known including their ability to attract or repel other magnets depending upon mutual magnetic pole orientations and to attract ferromagnetic substances. Embodiments describe fixtures having one or more magnets attracted to rails comprising ferromagnetic materials; as is well-known in the art, other combinations of magnetic attraction may be substituted. Some embodiments herein include features of flexible magnetic interconnects and solid state lighting systems found in co-owned U.S. Pat. No. 8,187,006 issued May 29, 2012, U.S. Pat. No. 8,491,312 issued Jul. 23, 2013 and U.S. Pat. No. 8,651,711 issued Feb. 18, 2014. These documents are incorporated by reference in their entirety in this application to supplement the detailed description below. Other types of magnetic connections can be used with the inventive concepts described in the embodiments below.

For the purposes of this disclosure, the term "polarity" is generally used to describe relative electrical potential, such as that between the relative voltage of the anode ("positive") and cathode ("negative") poles of a battery. Voltages used with embodiments may be direct current (DC) or alternating (AC). In a similar manner, "insulating" generally refers to electrical isolation. The context should be used to clarify the meaning of these terms.

In addition, for the case of temperature-sensitive lighting fixtures, such as those employing LEDs, the physical size of the pivoting lighting fixture may be determined primarily by the size of the heat sink required for the particular LED assembly and application environment.

Other objects, features, embodiments and/or advantages of the invention will be apparent from the following specification taken in conjunction with the following drawings.

BRIEF DESCRIPTION OF THE DRAWINGS

FIG. 20 is an exploded isometric view of FIG. 21 illustrating an axially interleaved helical electrode rail system having an electrically conductive center core.

FIG. 21 is an isometric view illustrating an axially interleaved helical electrode rail system having an electrically conductive core.

FIG. 22 is a cross-sectional view of an axially interleaved helical electrode rail system, as shown in FIG. 20 and FIG. 21, having an electrically conductive core, with a lighting fixture magnetically mechanically and electrically attached to the electrode rail.

FIG. 23 is a cross-sectional view of another embodiment of an axially interleaved helical electrode rail system having an electrically conductive center core, the center core having formed regions, with a lighting fixture magnetically mechanically and electrically attached to the electrode rail.

FIG. 32-A is an exploded isometric view of FIG. 32.

DETAILED DESCRIPTION

The embodiments of this disclosure include electrical distribution systems employing axially interleaved contact arrays for lighting and other applications. Embodiment systems include periodic interleaved electrical contacts along the major axis of a substantially cylindrical electrode rail system configured to enable fixtures to be electrically connected at different positions along the electrode rail and to also allow rotation of the fixture around the electrode rail while remaining connected electrically and mechanically with the rail. Embodiments of rails are disclosed that can be bent at an angle relative to the axis in many directions because of the substantially symmetrical coaxial and flexible structures. Lighting fixtures (and/or other electrical devices) in the subject embodiments may be magnetically attached using magnetic components incorporated into the rail and fixture assemblies, or may be electrically and mechanically attached using conventional spring electrical contacts, insulation displacement contacts, or mechanical pressure contacts and combinations of the aforementioned. Although it is generally desirable to allow unrestricted movement of the fixture along and around the rail, it may be desirable to restrict the mechanical removal from the rail in a radial direction through the use of mechanical features that prevent removal without some fixture disassembly or sliding the fixture axially to the end of the rail. However, configurations that allow easy repositioning of the fixtures at least over a local section of the rail to different axial or circumferential locations is considered to be an important feature of these inventive concepts. Electrical connections at the rail contact/fixture contact interface that require what might be generally considered to be permanent means such as soldering, welding, or other forms of adhesive bonding, or crimping or wire nuts should not be considered to be characteristic of removable electrical fixtures for the purposes of this disclosure.

Figure 1:
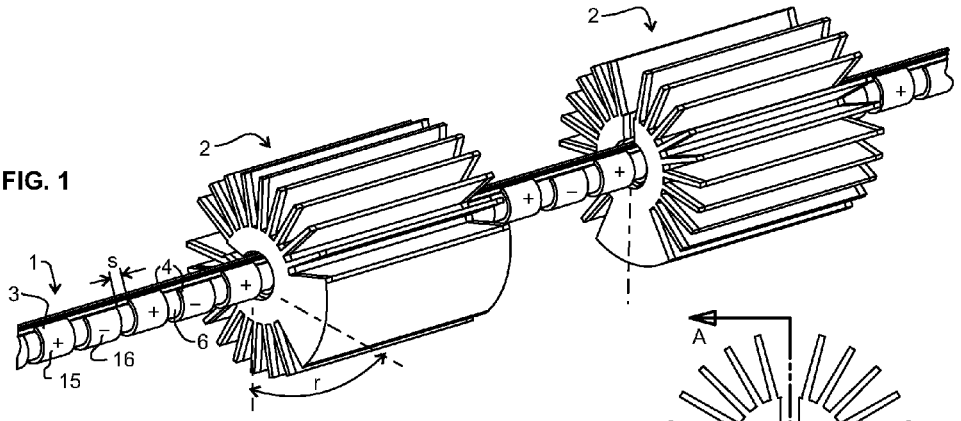
FIG. 1 is a perspective view of an axially interleaved electrode rail assembly having tabbed electrodes and showing two magnetically attached lighting fixtures attached to the rail, the fixtures being positioned at different axial and radial locations with respect to the rail assembly.

FIG. 1 shows an example of an axially interleaved contact rail assembly 1 with representative lighting fixtures 2 electrically and magnetically connected to rail assembly 1. FIG. 1 illustrates the two lighting fixtures 2 rotated at different angles about the rail assembly 1. Referring to FIG. 1 through FIG. 8, an embodiment of an axially interleaved contact rail 1 may be constructed in part of formed metallic electrode assemblies 3 and 4. In this example they may be identical interleaved mechanical parts with one electrode as the positive electrode side 3 and the other as the negative electrode side 4. In this example, each electrode half contains an inwardly directed flange 14 to which positive pole electrode tabs 15 or negative pole electrode tabs 16 are integrally formed. Electrode tabs 15 and 16 are shown formed into band contacts. They are illustrated as substantially circular in cross-section, but may be other cross-sections such as faceted surfaces, elliptical, etc. The circumferential extent of the illustrated formed tabs on internal flange 14 allow almost full 360-degree rotation of fixtures about the rail while maintaining continuous electrical connection. Alternatively, tabs may be extended to form a closed band to allow rotation through 360 degrees, or shortened if a smaller rotation range is desired.

For magnetically attached fixtures, the rail systems may comprise a ferromagnetic material. Materials for the electrically conductive magnetic electrodes may comprise steel, plated with materials such as nickel and tin for enhanced electrical contact resistance. Other materials for the magnetic electrically conductive rails may comprise steel that is clad, coated or plated with aluminum and/or copper or other metals to increase electrical conductivity and/or reduce contact resistance. Additional electrically conductive materials such as strips or wire may be incorporated into the rail assemblies to increase electrical conductivity over a predominately steel construction. Additionally, the rails may have varying cross-sections and need not be formed from uniform thickness sheet material. For embodiments not requiring magnetic attachment, steel or other ferromagnetic materials are not required in the rail constructions, but may be included for mechanical strength. These non-magnetic electrode components may comprise materials such as aluminum, copper, flexible printed circuits, and metallic coated insulators singly or in combination for portions of the electrical distribution system as is well known in the field of electronic and electromechanical arts.

In the embodiment illustrated in FIG. 1 through FIG. 8, the electrodes 3 and 4 are assembled onto an electrically insulating core 6; this insulating core may be fabricated in one or more pieces that are extruded or molded from various polymer materials (e.g. PVC, vinyl, polycarbonate, or elastomeric/rubber materials). Core 6 and/or electrodes 15 and 16 may contain additional mechanical features such as barbs, and raised features to mechanically retain the electrodes onto the core and to join the parts and maintain the proper spacing of the positive and negative electrode cores. The electrode rails may also be crimped or interference fit onto the insulating core. The rail assembly may be bent at an angle relative to the axis in any direction. Other electrode construction methods may include discrete electrode tabs welded, soldered, brazed or formed onto a strip of conductor material, or discrete tab portions assembled to one another.

Figure 2:
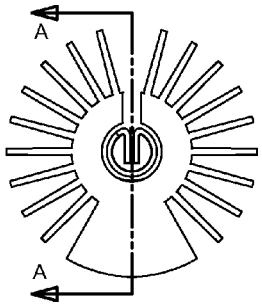
FIG. 2 is an end view of FIG. 1
Figure 3:
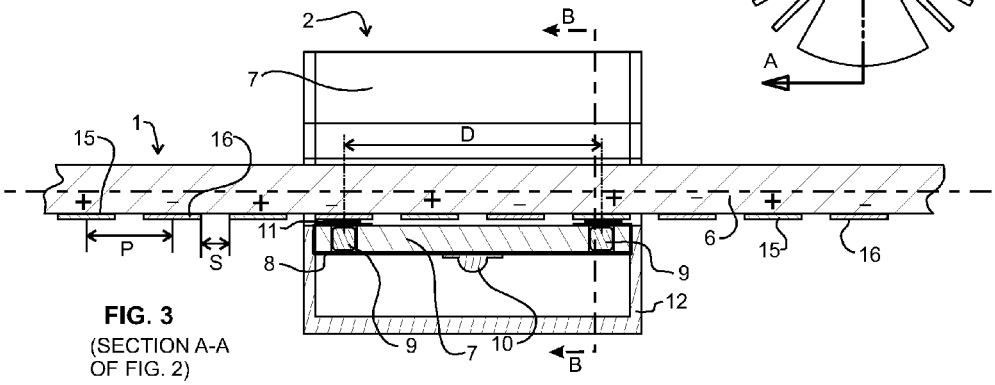
FIG. 3 is an axial cross-sectional view (section A-A of FIG. 2) of FIG. 1 and FIG. 2.

FIG. 2 is a cross-section through the fixture shown to the right of FIG. 1. FIG. 3 is a cross-sectional view through section A-A indicated in FIG. 2. The rail system of this embodiment has interleaved positive electrode contact tabs 15 and negative electrode contact tabs 16 along the axis of the rail, electrically insulated from one another and separated axially by distance "S" and electrode pitch "P" (FIG. 3). Generally, as a result of interleaved contacts down the length of the rail, circumferential electrical contact tabs allow continuous electrical connections to be made while luminaires are pivoted by more than 180 degrees around the rail. The circumferential bands illustrated wrap almost a full 360 degrees around the central axis of the rail, allowing electrical connection during almost 360-degree rotation of lighting fixtures about the axis of the rail assembly. As illustrated, lighting fixture electrical contact pads 11 are spaced in a relative axial position to one another and separated by a distance D which is an approximate odd multiple of the electrode pitch such that the positive and negative contact are positioned approximately in the center of the rail contact tabs 15 and 16, corresponding to the appropriate voltage difference required for the attached fixture. More than two sets of interleaved contacts may be provided along the major axis to provide additional lines for control signals, etc. The two illustrated rail conductor electrodes are electrically isolated from each other. In general, the heat sink 7 is electrically isolated from the fixture contact tabs, but with direct current systems it may be desirable to connect the heat sink to electrical ground. Fixture contact tabs are not required to be oriented in a line parallel to the rail axis, but may be offset both radially and axially. Contact tabs need not be of the same size, same pitch or even of the same number along the rail. For example, one set of electrode tabs may be smaller to allow the lighting fixture to turn off by pivoting or translating the fixture contacts off the tab. The electrode flanges may also be located at different angular positions from one another in the insulating core.

FIG. 3 illustrates lighting fixture contacts 11 spanning two sets of interleaved rail contact tabs, but obviously a single positive-negative spacing or other multiples could be employed The size of contacts 11 may be designed such that electrical shorting between rail electrodes is not possible; for example the size of the contact pad 11 may be smaller than the electrode tab spacing "s". Indexing or locating features may also be incorporated into the rail and fixture to aid in locating the contact pads 11 near the center of electrode tabs. Although a "positive" and "negative" are described, it is understood that for various alternating-current (AC) fixtures, a polarity orientation is not required. Even with direct current (DC) lighting fixtures and power supplies, the use of diodes or other circuitry can be incorporated to protect systems from reverse polarity or short-circuit attachment conditions through known techniques.

Figure 6:
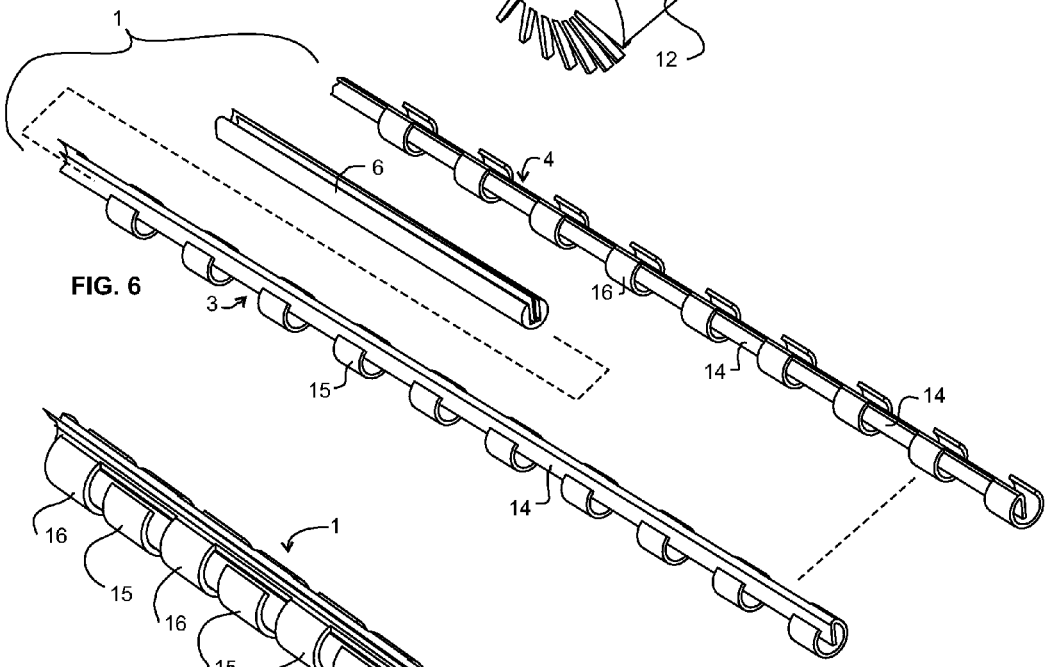
FIG. 6 is an exploded isometric view of the axially interleaved tabbed electrode rail system of FIG. 1 through FIG. 4.
Figure 7:
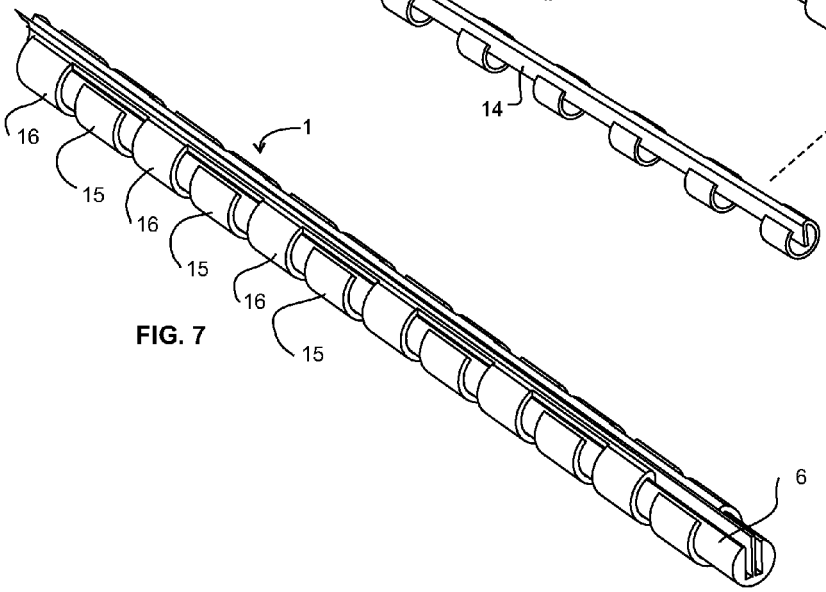
FIG. 7 is an isometric view of the axially interleaved tabbed electrode rail system of FIG. 1 through FIG. 4 and FIG. 6.

As illustrated in FIGS. 3 and 7, there is a repeating sequence of positive 15 and negative 16 contacts in a line parallel to the axis of the rail. This shows an inherent consequence of the axially interleaved geometry; if the fixture is moved in an axial direction, the fixture contacts will make electrical connections to different rail electrode contacts in sequence. FIG. 3 shows a fixture that uses magnetic attachment. Loosely constrained magnets 9 are attracted to ferromagnetic material in rail 1 to provide electrical contact between fixture contact pads 11 and rail electrodes. The fixture and rail construction are shown in FIGS. 5 and 6.

Figure 4:
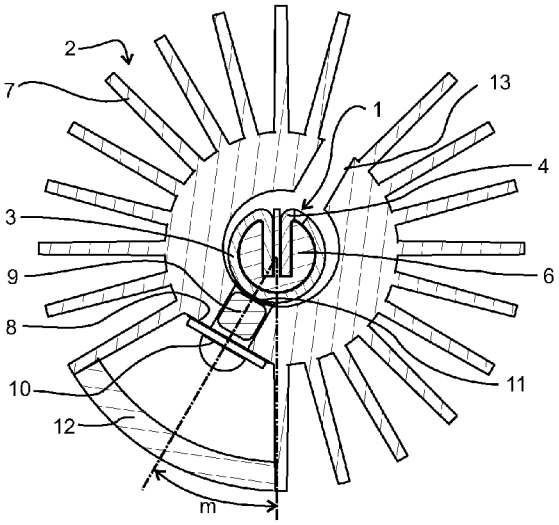
FIG. 4 is a radial cross-sectional view (section B-B of FIG. 3) of FIG. 1 and FIG. 3.

FIG. 4 shows a cross section at the position along line B-B of FIG. 3 followed by a rotation though angle "m" as indicated. Comparing FIGS. 3 and 4 shows how the magnetic attraction forces maintain electrical and electrical contact between the fixture and rail. Inspection of the cross-section of the electrode cross-section shows how the range of angles through which the puck can be rotated extends from a position near the top of the rail counterclockwise though an angle far in excess of 180 degrees. This range of angle depends upon the circumferential extent of the band and the circumferential width of the fixture contact pad. This circular band contact is shown in FIG. 6.

Figure 5:
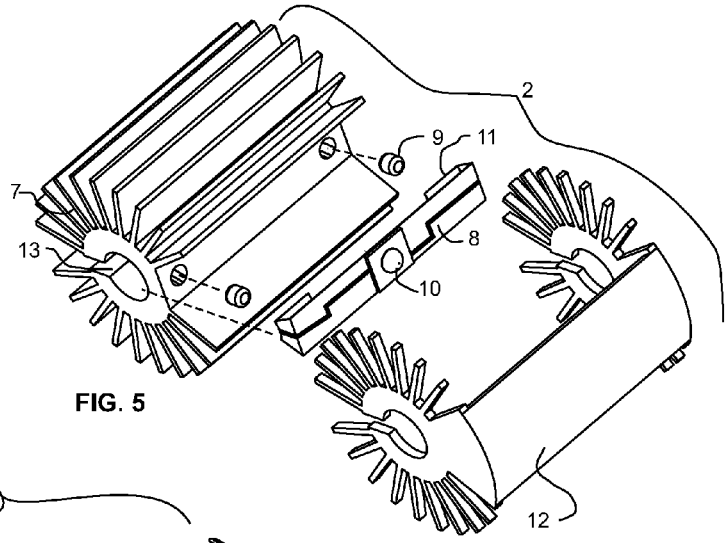
FIG. 5 is an exploded isometric view of the example lighting fixture of FIG. 1 through FIG. 4.

In the fixture 2 illustrated in FIG. 5, similar to embodiments described in referenced U.S. Pat. No. 8,187,006 and U.S. Pat. No. 8,651,711, a flexible printed circuit (FPC) 8 with LED 10 and other circuitry, power and control components may be joined to the surface of the heat sink 7, and wrapped around to the internal diameter of the heat sink whereby contact pads 11 on FPC 8 are located adjacent to cavities in the heat sink into which loose fitting permanent magnets 9 are contained. The LED and other power components may be thermally attached to the heat sink using any of the known thermal interface materials including thermal greases, tapes, and adhesives. The fixture 2 illustrated has a slotted opening 13 that may allow sliding past mounting/hanging hardware with an internal core diameter larger than the axial rail diameter; the slot may be designed to allow installation at any location along the rail, or sized smaller such that fixtures must be slid on from an end of a section of the rail, or at a rail position with a smaller diameter. With the illustrated system, the thermal conduction pathway away from the LED is configured to be principally contained in the fixture's heat sink. As a result, the mechanical precision mating requirements and contact area of the fixture to the rail can be reduced compared to approaches requiring efficient thermal conduction across the interface of parts that move relative to one another. When the fixture is installed onto the rail, magnets 9 are attracted to the ferromagnetic material in the electrode rail, and compress electrical contacts 11 located adjacent to the magnets, thereby establishing power to fixture 2. Magnets 9 may also provide all of the mechanical retention force required for the fixture, or auxiliary mechanical 77 or magnetic retention 80 features (not shown) may be incorporated into the fixture. Fixture 2 may be rotated freely about the axis of the rail, while maintaining the electrical contact. The fixture may be translated to any position along the axis of the rail by disengaging the magnetic contacts by first moving the fixture radially and then moving the fixture axially along the rail to a new position, or by sliding the fixture along the rail and letting the magnetic contacts slide across rail electrode contact surfaces.

Figures 8, 9, 10, 11:
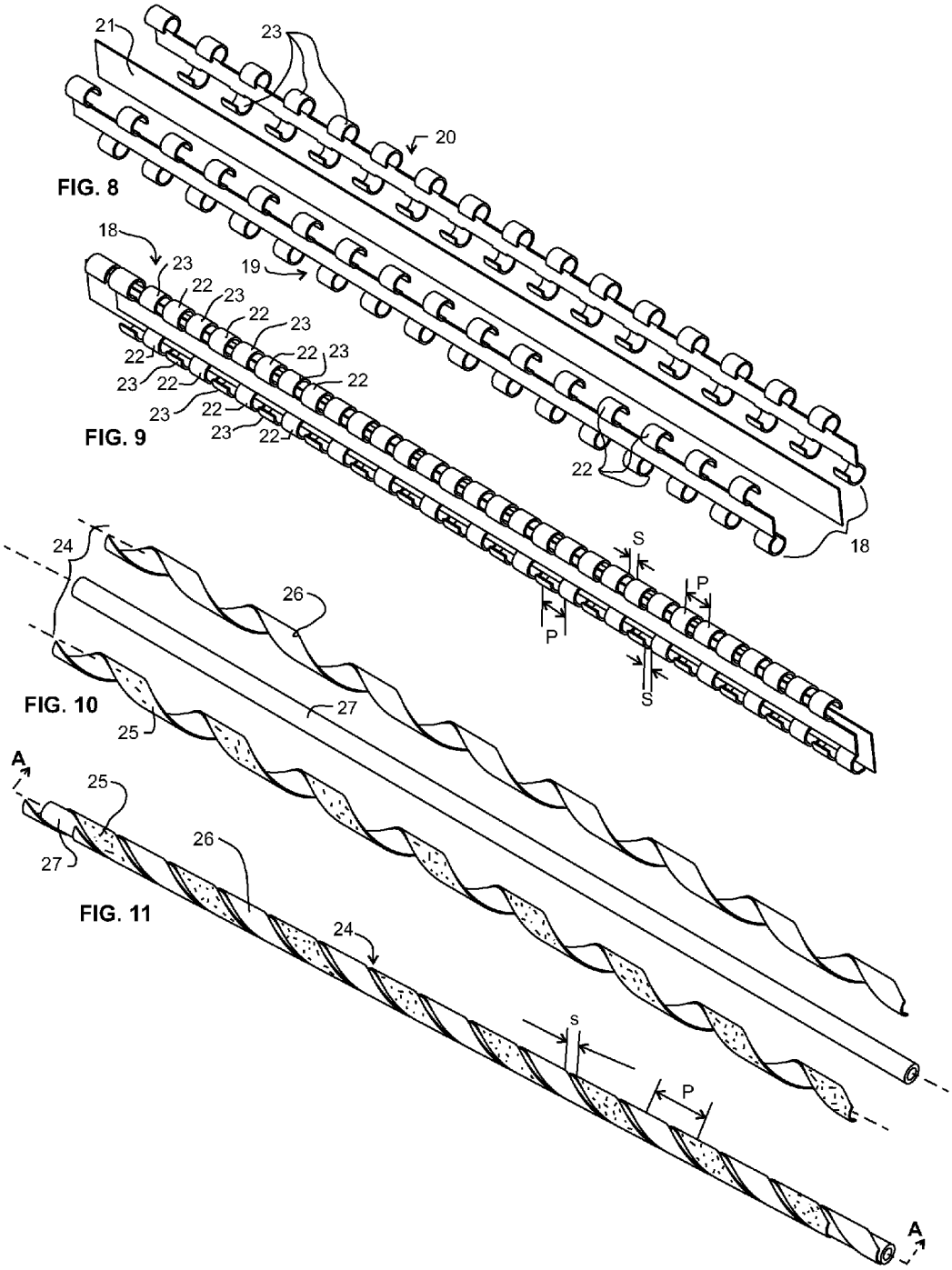
FIG. 8 is an exploded isometric view of FIG. 9, illustrating an electrode rail system having dual top and bottom sets of axially interleaved contacts.
FIG. 9 is an isometric view of an electrode rail system having dual top and bottom sets of axially interleaved electrode contacts.
FIG. 10 is an exploded isometric view of FIG. 11 illustrating an electrode rail system having two axially interleaved helical electrodes.
FIG. 11 is an isometric view of an axially interleaved electrode rail system having two helical electrodes.

FIG. 8 and FIG. 9 illustrate an embodiment of a double-contact rail system 18 having a top and bottom row of circular electrode tabs 22 and 23. FIG. 8 is an exploded view showing positive electrode 19, negative electrode 20 and insulator 21. FIG. 9 is an assembled view of FIG. 8 showing the axially interleaved band contacts 22 and 23. The parts may be joined together using mechanical formed interlocking features, adhesives, or insulating rivets. This construction may provide additional mechanical strength although pivot angles are restricted compared to the single rail system. Since flat electrical rails are exposed on opposite sides of the center of the double contact rail system 18, this rail may be configured as a hybrid embodiment also capable of attaching more traditional non-pivoting fixture attachment similar to those for the tracks disclosed in U.S. Pat. No. 4,861,273, U.S. Pat. No. 6,244,733 and U.S. Pat. No. 7,092,257.

The embodiment above has much less axial symmetry than the first embodiment, so it would be expected to be more difficult to bend as readily in all directions perpendicular to the rail axis. Embodiments that will be described below may be bent more readily in any direction relative to the rail axis compared to the systems described above. In addition, providing more than two axially interleaved contact sets can be accomplished by increasing the number of electrodes in a straightforward manner without affecting the higher degree of axial symmetry.

FIGS. 10 and 11 illustrate an embodiment of an axially interleaved contact array comprising a helical electrode rail system 24. In this embodiment, two or more helical electrode sections 25 and 26 are formed and assembled to an insulating core with air or another electrical insulator separating the electrodes. The two interleaved helixes illustrated form alternating electrode contacts in the axial direction that allow attachment and axial translation and rotation of magnetic fixtures. This is an axially interleaved contact rail system since a path essentially parallel to the axis of the rail on the surface of the rails will intercept a sequence of different rail electrode elements. In this example, depending on the relative size and spacing of the conductor helixes and mating fixture contacts, translation along the rail axis will generally be required in order to rotate the fixture about the rail axis while maintaining electrical connections. It is possible to continuously maintain electrical contact between the fixture and the rail in rotating through more than 360 degrees by moving the fixture in a helical path matching the helix pitch. The representative example of FIG. 10 and FIG. 11 shows a formed flat strip helical conductor. Many different cross-sections of conductor are possible (e.g. round, triangular, rectangular, square, trapezoidal, etc.). The helical electrodes may be supported with periodic insulating spacers as an alternative to the flexible tubular core insulator 27 shown. These type of helical electrodes may be fabricated by continuously forming and wrapping electrode strip or wire material around an insulating core; the electrodes may be attached to the core by tension, interlocking mechanical features (e.g. barbs or indentations in the electrodes and/or core), or may be thermally or adhesively bonded. Locating/guiding features for the fixture such as an embossed screw thread feature in the insulator that mates with a similar feature in the fixture may be incorporated. Rail systems may be fabricated with more than two nested electrode/contact helixes by a straightforward extension of the structure of FIGS. 10 and 11. Interleaving more than two electrodes may provide additional electrical connections to the fixture to provide different illumination levels, change color or connect to a different supply circuit with relatively "dumb" luminaires (those without digital electronics) or to provide digital control signals for "smart" luminaires.

The helical configuration also has the inherent geometric characteristic of axially interleaved contacts that pure axial translation of the fixture will result in fixture contacts coming into contact with the axial interleaved contacts in sequence. In addition, the fixture contacts in helical form will also sequence through the different helical electrode contacts as a result of pure rotation of the fixture about the rail. Once contacts are positioned as desired, the fixture can maintain electrical connections with the rail by moving in a combined axial/rotational motion that follows the rail electrode helical geometry.

Figure 12:
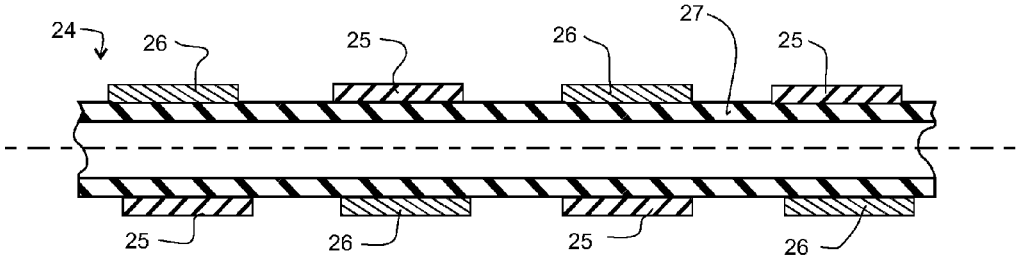
FIG. 12 is a cross sectional view (section A-A of FIG. 11) of the helical axial interleaved electrode rail system of FIG. 10 and FIG. 11.

FIG. 12 is a cross-section of the electrical distribution rail of FIG. 10 confirming that it is an axially interleaved contact array. On either side of the rail axis, contacts 25 are located between contacts 26 and vice versa. Both helical electrodes are supported by the insulating core 27, which as illustrated is tubular.

Figure 13:
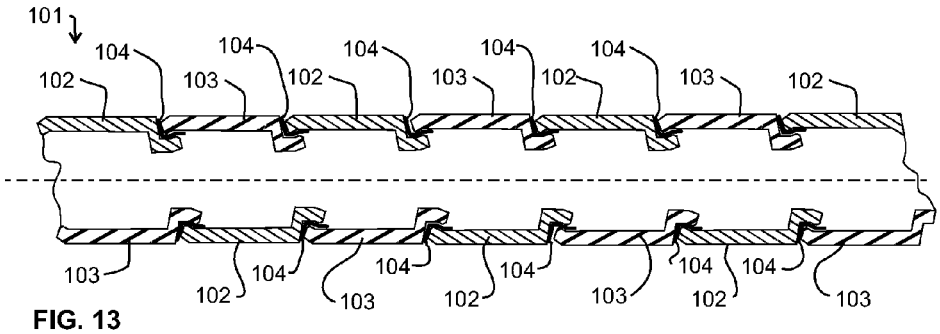
FIG. 13 is a cross sectional view of another axially interleaved helical electrode rail system embodiment having adjacent overlapping helical electrodes providing mechanical support.

FIG. 13 is a cross-sectional view of an alternative embodiment helical electrode rail construction 101. In this embodiment, the tubular core insulator 27 in the previous embodiment has been replaced with an insulator 104 that is also a helix. The insulator 104 electrically isolates helical electrodes 102 and 103 where they overlap one another. The insulator 104 is adapted to be a mechanical bridge between the electrodes 102 and 103, which provide mechanical support for each other.

Figure 14:
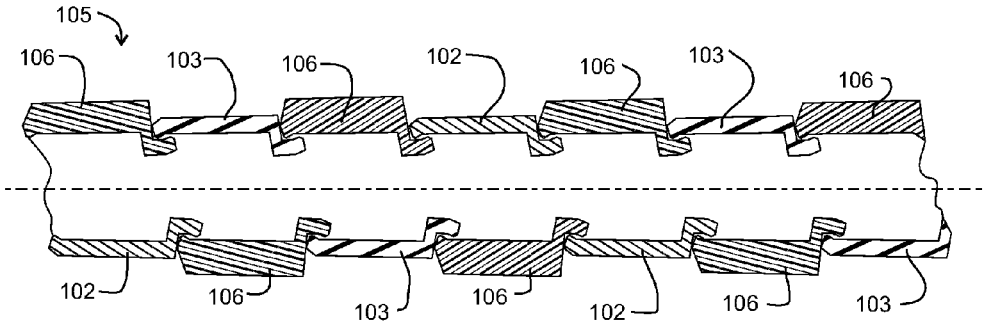
FIG. 14 is a cross sectional view of another axially interleaved helical electrode rail system embodiment having two helical electrodes separated with helical insulators providing electrode support.

FIG. 14 shows another helical embodiment of axially interleaved electrodes. In this case, two helical insulators 106 are used to separate electrodes 102 and 103 so they do not overlap. In this case, as above, there is no separate tubular core. The insulating helixes provide mechanical support for the electrodes and vice versa. The insulating helixes 106 as illustrated project a greater distance from the rail axis than the electrodes 102 or 103. Recessing one or more electrodes below the surface may be useful in preventing accidental contact with electrical voltage potentials applied to the rails. This characteristic is not restricted to the embodiment illustrated in FIG. 14.

Figure 15:
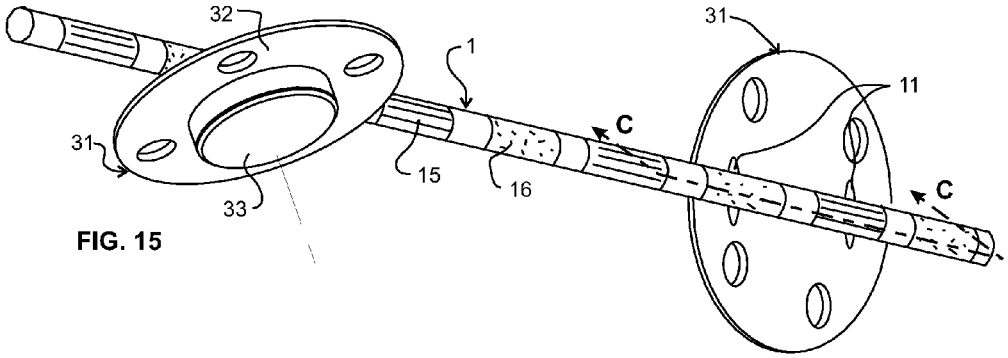
FIG. 15 is an isometric view of an electrode rail system embodiment showing two lighting fixtures magnetically attached to the axially interleaved contacts.
Figure 16:
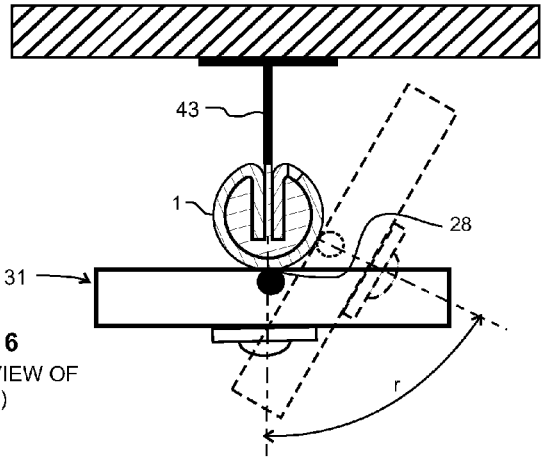
FIG. 16 is a schematic end view of FIG. 15 illustrating the lighting fixture rotated to a different radial position about the electrode rail system.

FIG. 15 illustrates two low-profile disc-shaped LED lighting fixtures 31, having a heat sink body 32, lens housing 33 and magnetic electrical contacts 11, electrically and mechanically attached to rail 1. Disc-fixture 31 is shown at two rotation angles "r" about rail 1, and suspended from bracket 43 as shown in the schematic end view of FIG. 16. For lower powered LED fixtures (e.g. 1-10 watts LED power), very lightweight fixtures may be constructed (e.g. 30-100 grams in weight).

Figure 17:
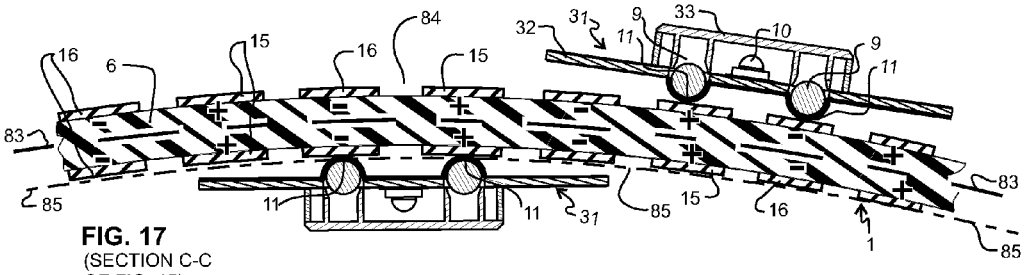
FIG. 17 is a cross-sectional view (section C-C of FIG. 15) of the electrode rail system with two lighting fixtures magnetically attached to the electrode rail. The electrode rail is shown formed in a curved arc.

FIG. 17 is a cross-sectional view representative of a longer distance along the section C-C direction illustrated in FIG. 15 of two disc-lighting fixtures 31 magnetically attached to ferromagnetic electrode tabs 15 and 16 on opposite sides of a bent rail 1. The minimum radius of curvature that will still allow fixture attachment will depend upon fixture and rail geometries. The flexible magnetic interconnects illustrated are less sensitive to mechanical contact geometries as described more fully in the referenced patent documents. In general, tighter rail bends are possible if fixtures will not be attached at sharp bends of the rail system, as long as interleaved axial contacts remain electrically isolated. FIG. 17 also shows rail axis 83. The area between rail axis 83 and line 85 represents a portion of the plane area referred to in defining the term axially interleaved. This planar area contains a sequence of positive electrode elements 15 and negative electrode elements 16 in a direction along the rail axis 83.

Figure 18:
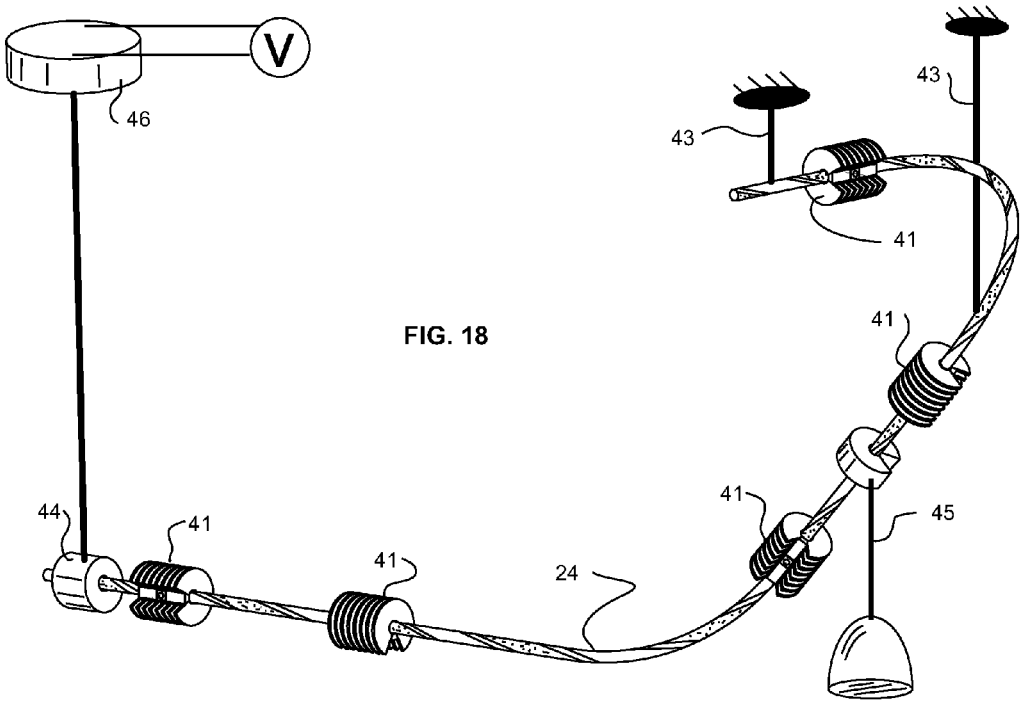
FIG. 18 is a perspective view of an exemplary axial rail system with multiple components including a compound-curved axial interleaved helical electrode rail, different types of lighting fixtures, power supply and mechanical mounts.

FIG. 18 illustrates an assembly comprising a helical electrode rail assembly 24, rail mounting and power-supply components 44 and 46, mechanical mounting hardware 43, finned LED fixtures 41 and pendant fixture 45. This figure illustrates how through the combination of the translation and rotation of the luminaires relative to the rail and the bending of the rail, the light from the luminaires can be directed as desired within an environment. Only one power-supply system attachment to the rail is shown, but multiple attachments could be used to provide multiple circuit control or to supply a portion of a discontinuous rail electrode. Electrical connections between external circuitry and the rails for power or control signals are generally considered to be semi-permanent. However, these connections to the rail may be done in a manner similar to the attachment of lighting fixtures as shown schematically with module 44.

Figure 19:
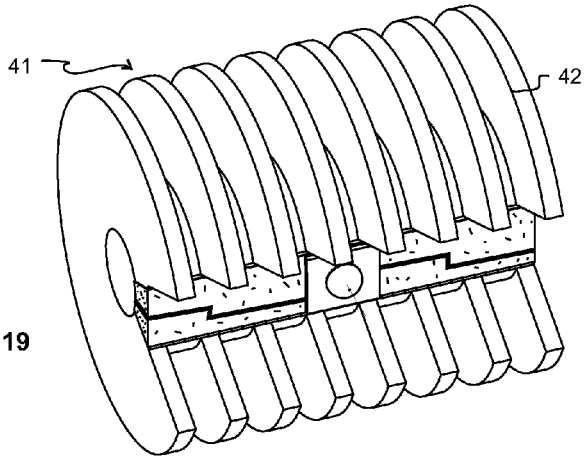
FIG. 19 is an isometric view of an LED lighting fixture having radial heat-sink fins.

FIG. 19 is an isometric view of a radially-finned LED fixture 41, where the fins 42 of the fixture with integral heat sink body 42 are arranged substantially perpendicular to the axis of the track when installed on a track assembly. These radially-finned configurations may have cooling efficiency advantages because of this fin orientation when mounted on a horizontal rail, and lower-cost production methods, and provide additional mechanical design and industrial design options. The shape of the heat sink can be modified to provide the desired combination of functionality and aesthetics. The embodiments described in this disclosure are not meant to be restricted to the configurations illustrated having flat fins. Alternate geometric structures for heat sinks or the use of different passive or active cooling systems such as thermal interface compounds, heat pipes, fans, etc. known in the art can be incorporated into fixtures.

In general, the core of rail assemblies may be made electrically conductive. Attaching one helical strip separated from the conducting tube core by an electrically insulated helical layer provides 2 electrical paths with only one helical electrode. In this configuration, the outer helical electrode in a DC system could be attached to the electrical ground for additional safety. Tracing a path on the surface of the rail system essentially parallel to the rail axis would result in alternating contact with the conductive core and the applied helical strip to form an axially interleaved contact system. In general for modular low-voltage lighting systems such as LEDs, the voltage levels are restricted to those considered safe for accidental human contact.

FIGS. 20 and 21 illustrate an electrically conductive core rail 47 embodiment. FIG. 20 is an exploded isometric view of assembled view 21. In this embodiment, rail 47 comprises an electrically conductive core 48 that forms one of the electrical conduction paths. Conductive helix 49 with insulating layer 50 is assembled to core 48. Insulating layer 50 may be applied to the core 48 and/or applied helix 49 as, for example, a polymer tape, paint-like coating, electrodeposited coating, or anodization.

Conductive core 48 may be solid, tubular, coated or plated with an electrical conductor, and at least one of the components in the rail assembly comprises a ferromagnetic material when magnetic attachment of fixtures is utilized. The core may be formed or embossed such that outer conductive helix 49 is recessed (FIG. 22) or flush (FIG. 23) with respect to the inner conductive core 48. This conductive core 48 in isolation would be an axially continuous electrode. However, the addition of helical electrode 49 makes this an axially interleaved contact system. This interleaving can be seen in the rail cross-section of FIG. 22 which shows electrodes (48 and 49) alternating along a path generally along the axis on the outer surface of the rail system.

FIG. 22 shows a cross-sectional view of a puck-type magnetic fixture 31 (similar to FIG. 15) attached to a rail assembly 47. In this example a protruding contact 52 is present in addition to non-protruding contact 53 to accommodate the height of conductive helix 49 above conductive core 48. This is similar to the lighting pucks with different electrical contact heights designed for the planar grid illustrated in FIGS. 48-57 of U.S. Pat. No. 8,651,711.

FIG. 23 illustrates a cross-sectional view similar to FIG. 22 with a rail assembly containing embossed features 54 in the conductive core. This example provides a substantially level, smooth contact surface along the rail. A conductive core may be used with helical electrodes having more than one added helix, and with tabbed electrode configurations similar to those described previously. Helical and tabbed rails may have varied contact thickness, width, cross-section, spacing and pitch or sequence, etc. within the same rail assembly As previously described, the electrode rails in all of the above examples may contain ferromagnetic components for magnetic electrical and mechanical connection of lighting fixtures to the rail assembly. It is also understood that the permanent magnet components contained in a lighting fixture may include combinations of permanent magnets and ferromagnetic pole pieces that optimize holding and contact force; the ferromagnetic pole pieces may serve as the actuators for a flexible electrical contact. Permanent magnet assemblies may also be designed to conduct electrical current through the pole-pieces and/or permanent magnets from the electrode rails to the electronics in the fixture. The fixture systems described may be spatially compact and low in weight, since bulky mechanical joints and parts are not required for positioning and aiming the light output. For example, a fixture with approximately 100 square inches of aluminum heat-sink surface area may be designed with a weight of around 100 grams. This amount of heat sink area would generally be suitable for an approximately 10 watt LED in a typical indoor environment; this weight is easily supported by small permanent magnet components and small rail sizes. Rail and fixture sizes may be scaled to larger sizes that support larger heavier, higher-power fixtures.

Figure 24:
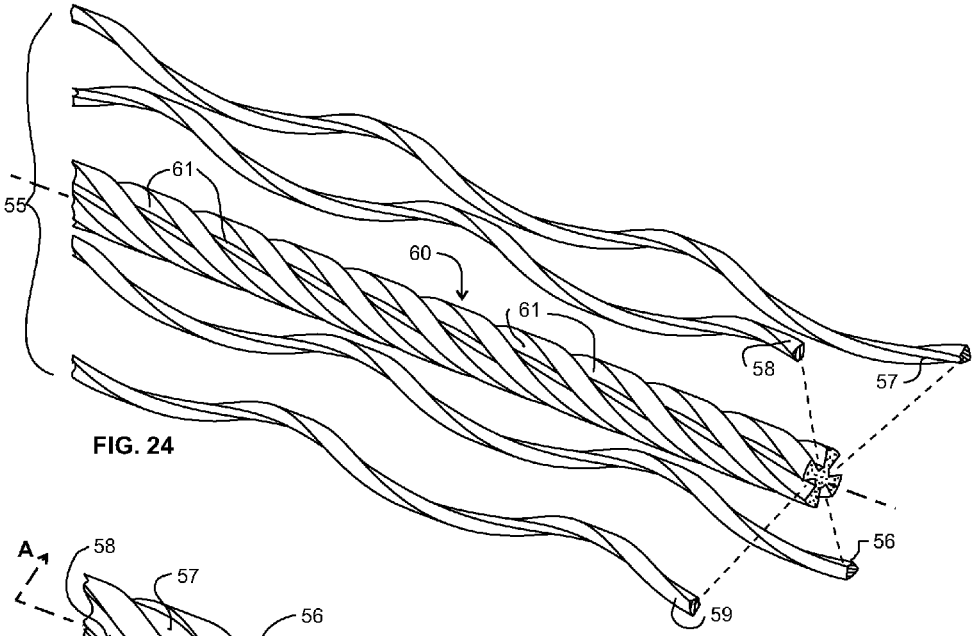
FIG. 24 is an exploded isometric view of FIG. 25 of an axially interleaved helical electrode rail system having four helical electrodes.
Figure 25:
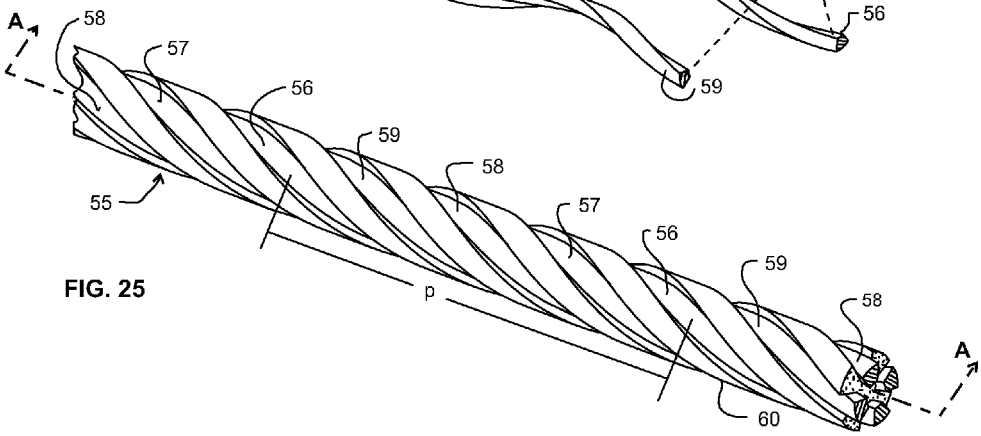
FIG. 25 is an isometric view of an axially interleaved helical electrode rail system having four discrete helical electrodes.
Figure 26:
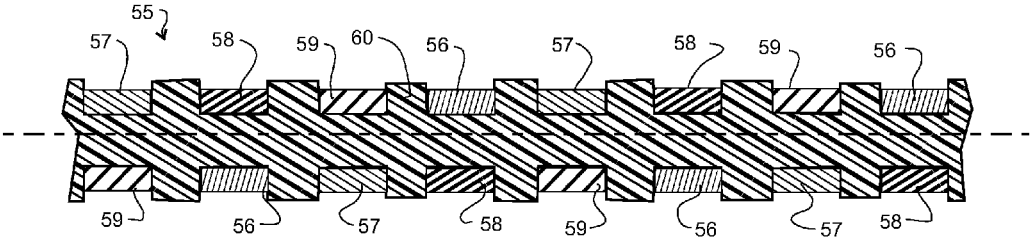
FIG. 26 is a cross-sectional view (Section A-A) of FIG. 25.

FIG. 24 and FIG. 25 illustrate an embodiment of a four-conductor helical electrode rail assembly 55. FIG. 24 is an exploded isometric view of FIG. 25 Helical rail assembly 55 includes four helical prismatic cross-section conductors 56, 57, 58, and 59, and insulating core 60 with recesses 61 that contain conductors 56-59. Generally, it is desirable to have helical structures characterized by a relatively large helical pitch "p" in FIG. 25 (e.g. greater than 1 turn per inch) in order to reduce conductor length and associated electrical resistance. As an example of practical sizes for relative scale purposes, helical electrode rail 55 in FIG. 24 through FIG. 28 is illustrated with a 0.5 inch outer diameter, and a helical pitch "p" of 4 inches.

Figure 27:
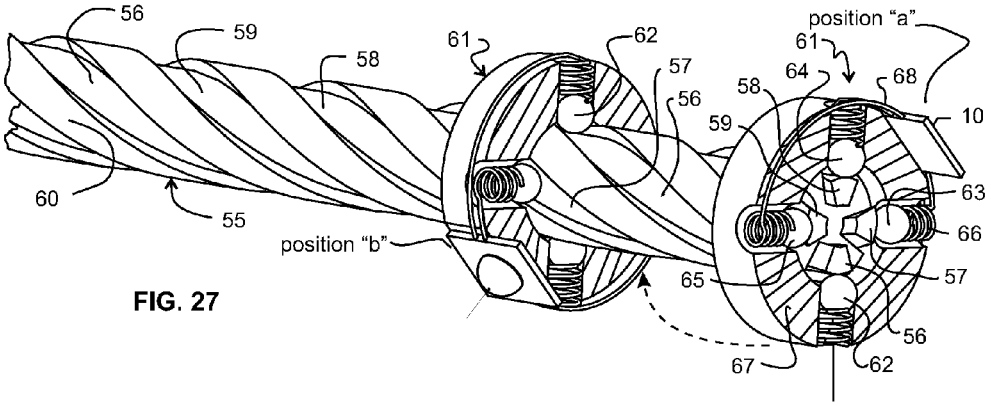
FIG. 27 is an isometric view of the four-electrode helical electrode rail system of FIG. 25 and FIG. 26, showing an exemplary lighting fixture electrically and mechanically attached to the rail, with the fixture shown translated axially and radially along the electrode rail.
Figure 28:
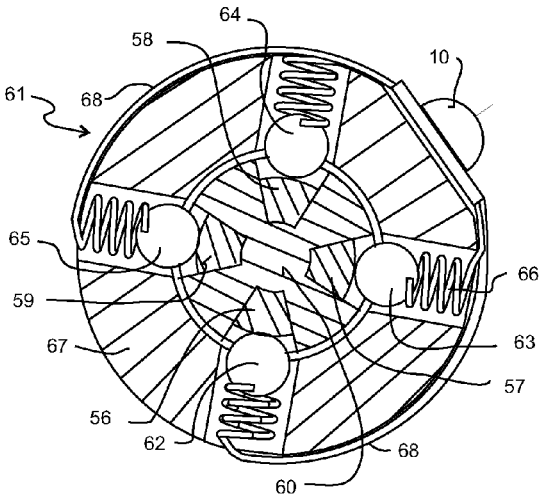
FIG. 28 is a cross-sectional view of the axially interleaved helical electrode rail system and lighting fixture of FIG. 27.

FIG. 27 and FIG. 28 illustrate an embodiment of a multiple contact fixture 61 electrically and mechanically attached to helical rail 55. For clarity of the mechanical and electrical interfaces, only the interior elements and part of the fixture housing are shown. Fixture 61 illustrates four contacts 62-65 that are spring loaded by helical springs 66 onto conductive helical electrodes 56-59. Wires 68 are electrically connected through springs 66 and contacts 62-65 to provide power and other control function to LED 10 and/or other electrical components within the fixture. In the example illustrated, the contacts may be configured to use only mechanical spring forces. In alternate systems the contacts may comprise a permanent magnet component, and the helical electrodes may comprise a ferromagnetic component. Four discrete electrical inputs are established from the electrode rail 55 to fixture 61. The fixture may also be moved axially along the rail while maintaining electrical contact, while at the same time rotating about the axis of the rail assembly. The helical geometry and size of the rail are design choices. In the example of FIG. 27 and FIG. 28 the light output of the LED 10 is rotated 180 degrees by moving the fixture 61 from "position a" to "position b". If the helixes have a pitch of four inches along the rail, then this distance between positions would be two inches. The shape of the helical rail electrodes and insulator may be designed to retain and guide the fixture 61 contacts and housing when repositioned along the rail, or include ramps or other mechanical mechanisms to disengage contacts from the recesses for translation without rotation. A central support rod could be added for additional mechanical strength without reducing axial symmetry.

For non-magnetic contacts, in addition to the spherical spring contacts shown in FIG. 27 and FIG. 28, it is clear that other contacts such as formed flat springs, pogo pins, etc., may be used.

The configuration of the insulating core and electrode rails may be designed to prevent accessibility of the electrode rails for safety purposes or to provide a key for mechanical attachment or a guide for movement. The electrodes 56-59 in this embodiment are recessed below the outer extent of the insulator 60. This recess may be used to limit casual contact to the electrodes or provide a guide for moving the fixture while maintaining the electrical connections.

Figure 29:
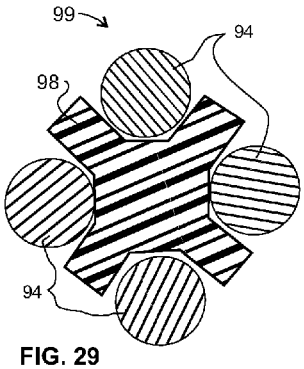
FIG. 29 is a cross-sectional view of an axially interleaved helical electrode rail system having a polygonal insulating core and four cylindrical electrical conductors.

FIG. 29 illustrates another helical electrode embodiment 99 with four conductors 94 and an insulating core 98. Compared to the embodiment of FIG. 25 with core 60, core 98 extends for a smaller distance from the axis than electrodes 94 so that contacts are not recessed.

Although illustrated as the same size and shape conductors, these helical conductors may be of varying cross-section and material type within the same rail and may comprise solid core or multistrand circular wires. For example, one wider recess may be used for keying a matching fixture pin to provide proper registration of the set of electrical connections. The number of conductor helixes may be different than four. Conductors may contain ferromagnetic materials or be a mix of ferromagnetic and non-ferromagnetic conductors.

Figure 30:
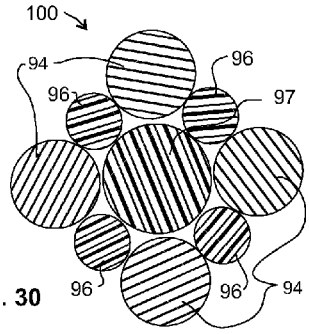
FIG. 30 is a cross-sectional view of a twisted axially interleaved helical electrode rail system having multiple cylindrical insulating members and four cylindrical electrical conductors.

Related helical conductor assemblies might also be produced by simply twisting together conductors, with an insulating layer between the conductors, versus a pre-formed insulating core assembly as illustrated above. This would be similar to replacing some of the wire strands with insulating cords in wire rope construction. An example of this is illustrated in FIG. 30. The helical rail system 100 has the same configuration of electrodes 94 as the rail system 99 of FIG. 29. However, instead of a one-piece insulating core 98, the core is an assembly of one larger cylindrical insulator 97 and four smaller cylindrical insulators 96.

Figure 31:
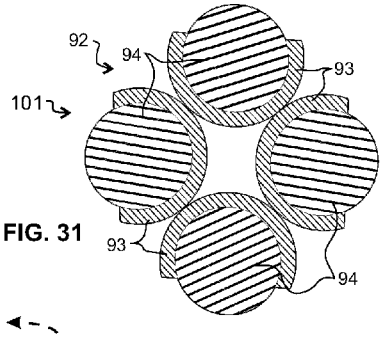
FIG. 31 is a cross-sectional view of a twisted axially interleaved helical electrode rail system having four discrete electrical conductors with partial insulating coating on each conductor.

An embodiment for a helical conductor assembly 101 that may be formed by twisting conducting wires 94 with insulating sheaths 93 is illustrated in FIG. 31. The insulating sheath 93 has been removed on the exterior surface of the rail assembly to expose the conductors 94. With low voltage, systems, the thickness of the insulating sheath 93 may be relatively thin and removed with mechanical means such as shaving or scraping blades or wire strippers after fabrication of the twisted wire rail assembly.

Such helical conductors are easily produced using wire-forming and spring-winding processes, and may be continuously applied to a core assembly during its manufacture. Lighting fixtures may also include clearance features between the fixture and rail, and mechanical or magnetic methods to disengage from the rail recesses in order to slide the fixtures to an alternate position down the rail as opposed to moving them through a screwing motion.

Generally the varieties of electrode rail systems described herein may be provided with a selective or removable insulation layer, or a continuous insulation layer that may be displaced or pierced when a fixture is installed onto the rail. For example, insulating tapes with removable tabs, segmented snap on insulators, coatings (e.g. printed insulating liquids, electro-deposited coatings, dipped coatings, etc.) or tapes with openings may be applied over the electrode rails. These insulators may be configured to limit or eliminate casual contact to the electrodes by the geometry of the openings in the insulator, or insulating tab coverings that may be removed in positions only where a fixture is installed. They may also be applied for aesthetic reasons before or after fixture attachment. The wider physical pin method described above for aligning fixture contacts or a visual key on the rail may be used with helical rails surrounded by insulation to orient insulation piercing contacts of fixtures at a desired pivot angle position.

Figure 32:
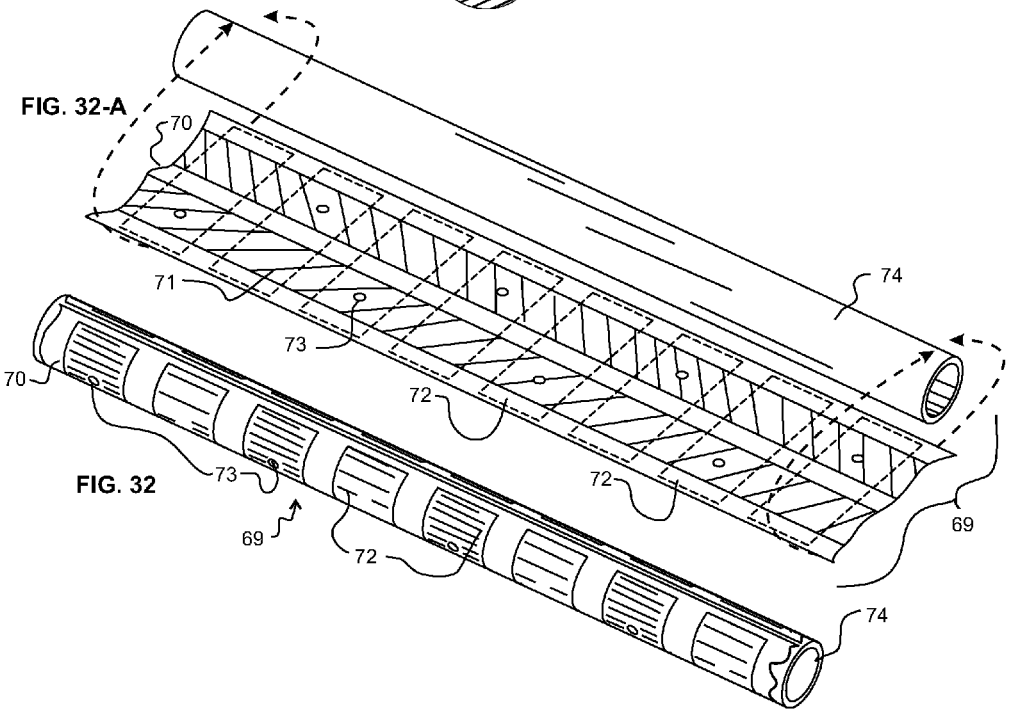
FIG. 32 is an isometric view of an axially interleaved contact rail system construction utilizing a flexible printed circuit wrapped onto a ferromagnetic core.

FIG. 32 illustrates an embodiment of an applied flexible circuit interleaved pole electrode rail 69. As shown in exploded view FIG. 32A, in this embodiment a flexible printed circuit (FPC) 70 is wrapped onto a supporting core 74 to form a contact structure similar to FIG. 7. Imaging of FPC allows a wider flexibility in forming more complicated meandering or serpentine patterns that may provide axially interleaved contacts. The use of The FPC assembly 70 may have conductors on one or both sides. For example FPC 70 illustrates two discrete electrode circuits 71 on the back side of FPC 70, connected to interleaved pole electrode tabs 72 on the outside surface of FPC 70 through plated-through-holes 73. For magnetically attached fixtures, core 74 may contain ferromagnetic components. More complicated electrode tab circuits may be readily fabricated on the FPC. FPCs or flat flex cables (FFC) may also be designed to wrap in a helical fashion onto the core. The core may also be used as an electrical circuit by providing openings in the FPC, or electrically connecting circuit traces of the FPC to the core. This approach could be applied to add axial interleaved connections to existing structures in a building, for example to add a low-voltage track system to an existing pipe section.

Figure 33:
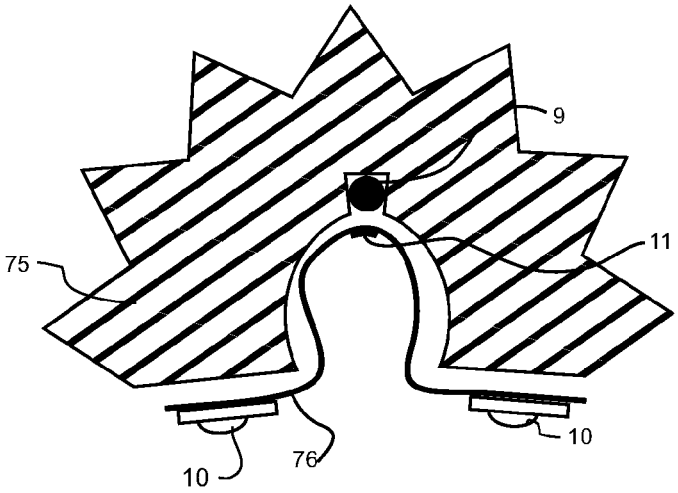
FIG. 33 is a schematic (unassembled) cross-sectional view of components of a heat sink lighting fixture with a magnetic interconnect.

FIG. 33 shows a schematic (unassembled) cross-section of components of an open heat sink fixture 75 having multiple LED's 10 mounted to FPC 76. As illustrated, this example has magnetically actuated contacts 11 positioned such that the fixture is installed over the top of the rail; consequently, gravity supplements the contact force as the rail supports the weight of the fixture, and the magnetic components 9 only require enough strength to provide electrical contact in this orientation. Additional mechanical means may be required to hold the fixture to the rail in other orientations.

Figure 34:
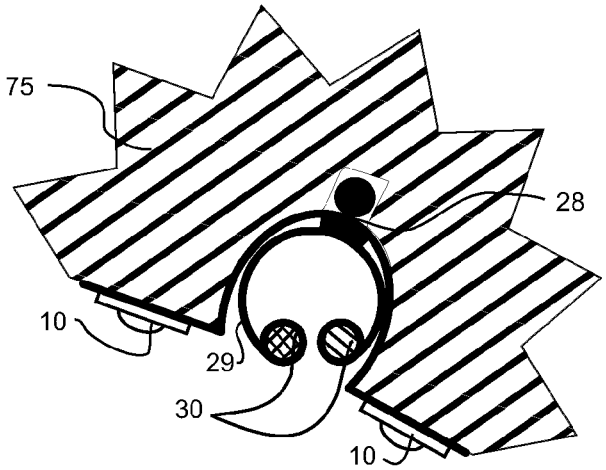
FIG. 34 is a schematic cross-section view of the fixture of FIG. 33 through an electrical connection installed on electrode rail system and pivoted at an angle about the rail.

FIG. 34 shows a schematic cross-section view of the fixture of FIG. 33 through an electrical connection installed on electrode rail 29 of tabbed form and pivoted at an angle about the rail. Also shown are auxiliary conductors 30 that may be incorporated into the two discrete electrode rails in order to increase electrical conductivity and mechanical strength. For example copper or aluminum wire or strip may be crimped, clad, welded or soldered into the ferromagnetic components during manufacture of the electrodes.

Figure 35:
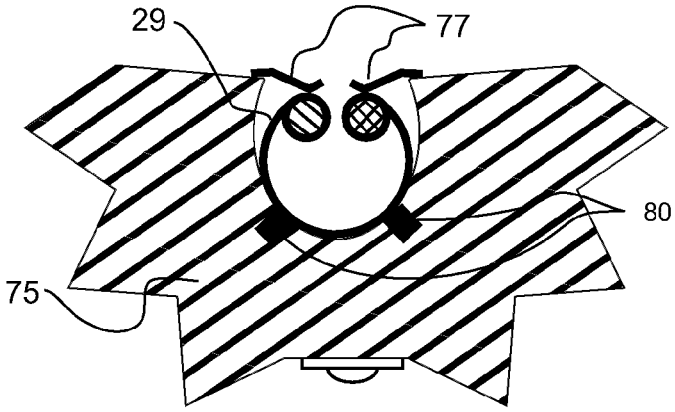
FIG. 35 is a schematic cross-sectional view of a lighting fixture magnetically, electrically and mechanically attached to an electrode rail system showing auxiliary mechanical retention.

FIG. 35 shows a schematic cross-sectional view of an open bore hanging fixture magnetically and mechanically attached to rail 29. This cross section does not go through the electrical contact; the electrical contact and wiring are not illustrated. Auxiliary mechanical retention feature 77 may support part of the weight of the fixture, and/or provide a safety feature for retention of the fixture. Auxiliary magnetic feature 80 provides additional mechanical attachment force.

Figure 36:
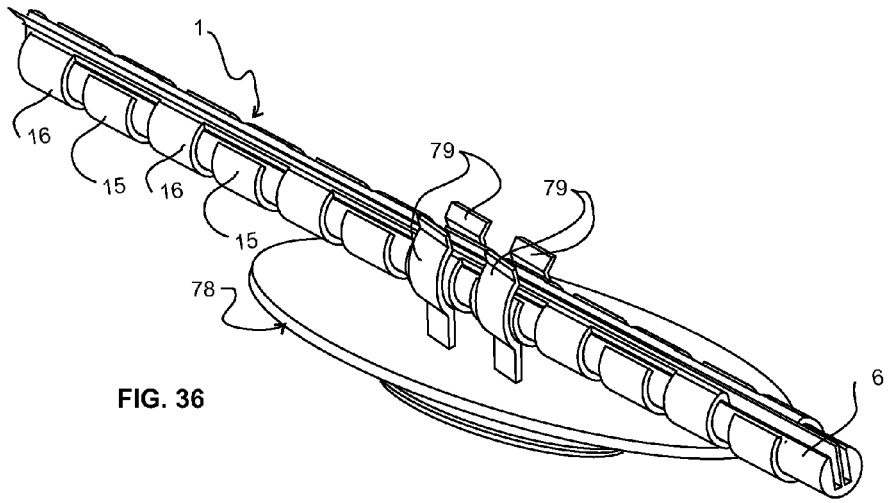
FIG. 36 is a schematic isometric view of a disk lighting fixture electrically and mechanically attached to an electrode rail using spring electrical contacts.

FIG. 36 shows a schematic isometric view of a disk lighting fixture 78 electrically and mechanically attached to electrode rail 1 using conventional (spring) electrical contacts 79. Other forms of spring beams may be incorporated into the interior of fixtures as alternatives to the spherical contacts 62-65 and helical springs 66 above. Further mechanical retention features may be incorporated into the fixture, and/or auxiliary magnetic retention components utilized.

Figure 37:
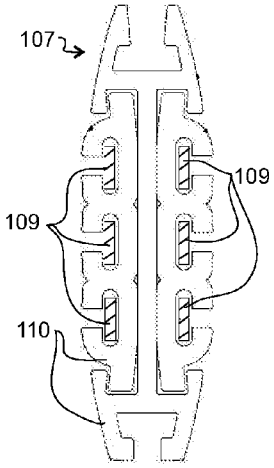
FIG. 37 (PRIOR ART)
FIG. 37 is a cross-sectional view of an exemplary prior art track-lighting electrode rail.
Figure 38:
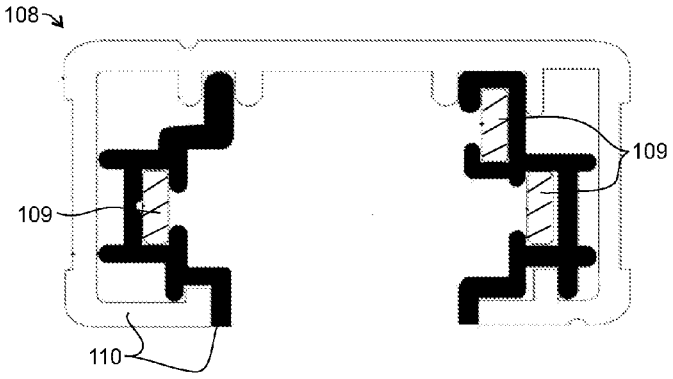
FIG. 38 (PRIOR ART)
FIG. 38 is another cross-sectional view of an exemplary prior art conventional track-lighting electrode rail.

FIGS. 37 and 38 are representative cross-sections of prior art axially continuous electrode rail assemblies 107 and 108. Linear contacts 109 of rectangular cross-section are located parallel to the rail axis and held in position by rail housing components 110. Housings are commonly fabricated from a combination of metal and polymeric pieces. The asymmetry in the cross-sections suggest that bending moments of these structures are not likely to be uniform in all directions perpendicular to the axis of the rail.

Figure 39:
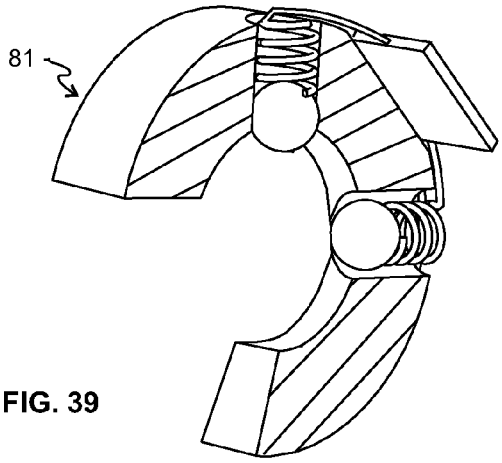
FIG. 39 is an isometric cross-sectional view of a lighting fixture with a partially open circumferential extent.
Figure 40:
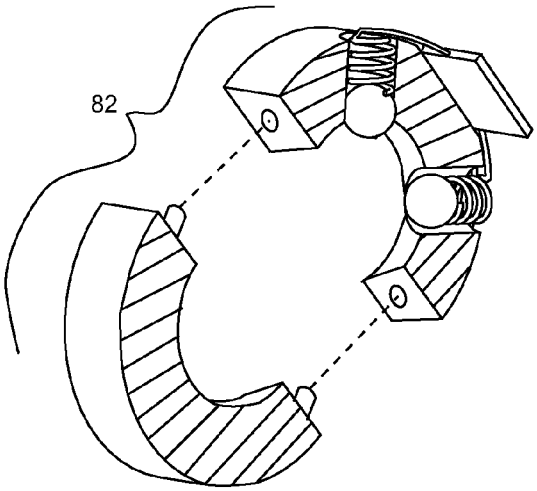
FIG. 40 is an exploded isometric cross-sectional view of a two-piece clamshell lighting fixture that may be assembled around an axial electrode rail system to form a fixture with a closed circumferential extent.
Figure 41:
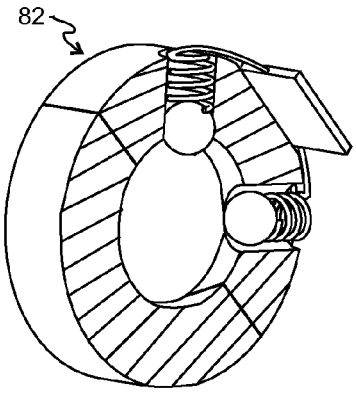
FIG. 41 is an assembled isometric view of FIG. 40.

As described above, fixtures may be configured for installation only from the end of a rail section, or may comprise partially open fixtures 81 to allow the fixture to be installed at any position along the rail assembly illustrated schematically in FIG. 39. Clamshell housing fixtures 82 with separate pieces may be utilized to affix a fixture to a rail assembly at any point as illustrated in FIG. 40, but restrict radial removal once assembled to the rail as illustrated in FIG. 41.

Variations on the inventive concepts above are possible and are considered to be within the scope of this disclosure. Features of different embodiments may be combined in different ways. Although substantially cylindrical shapes are used to illustrate the embodiments and are a preferred shape in general, rail systems of other shapes may be used as alternative embodiments. For example, interleaved wires that are wrapped around a triangular core would provide axially interleaved contacts through triangular helixes. The axially interleaved contact bands illustrated in FIG. 7 do not need to be circular. Portions of electrodes and contacts may pass over or under one another to increase the flexibility of these inventive concepts by providing an axially varying periodicity of helical contacts or to combine helical electrodes with band contacts. The discussion above considers the thermal management of the light emitter to come principally from thermal conduction to the luminaire heat sink and passive dissipation through convection cooling from the heat sink to the air. The mechanical connection of the fixture to the rail system could be modified to provide an alternate thermal conduction pathway including a portion of the rail. Tubular portions of the rail could include phase change material "heat pipe" regions or flowing liquids . . . . If the rail is used for thermal management, auxiliary heat sinks of the same general form of fixtures disclosed but without light sources could be employed or fillers could be added to the rail to increase thermal conductivity. Alternatively, active cooling methods such as air movement devices could be incorporated into the fixture and powered by the rail system.

Although one benefit of the substantially symmetric rail system disclosed is the ability to bend the rail, the electrical pivoting and translational contacts may be used with rigid rail configurations. The electrical and mechanical contact configurations may also find application in non-track lighting configurations such as in desk and floor lamps using as few as one luminaire. The track lighting concepts are compatible with other types of solid state light emitters including OLEDs as well as conventional non-solid state lamps. As the electrical connection to the rail from a power source may be made using the methods described for luminaires, it is also possible to apply the distributed electrical connection system concepts in non-lighting applications.

For the purposes of this disclosure, the meaning of "any combination of A, B, or C" shall be interpreted to mean any one of the following: A; B; C; A and B; A and C; B and C; A and B and C.

Several embodiments of the invention have been described. It should be understood that the concepts described in connection with one embodiment may be combined with the concepts described in connection with another embodiment (or other embodiments) of the invention.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. An electrical distribution system comprising:

a rail having an axis and a length in the axial direction and an outer surface of the rail located about the axis, wherein the rail comprises a plurality of axially interleaved contacts and electrical insulation wherein the electrical insulation is adapted to cover at least a portion of an axially interleaved contact of the rail; and a fixture comprising at least two fixture contacts, wherein the fixture is configured for mechanical attachment to the rail in a position outward of the outer surface of the rail; and wherein the at least two fixture contacts are configured to make electrical connections to at least two of the axially interleaved contacts and wherein at least one of the fixture contacts comprises insulation displacement means for piercing the electrical insulation.

2. The electrical distribution system of claim 1, wherein the fixture is adapted to have a shape that surrounds the rail to an extent that restricts removal of the fixture in directions perpendicular to the axial direction at a time after mechanical attachment of the fixture to the rail.

3. The electrical distribution system of claim 1, wherein the axially interleaved contacts are configured to extend in a helical path about the rail.

4. An electrical distribution system comprising a rail having a longitudinal axis and an outer surface positioned about the longitudinal axis, wherein the rail comprises a polymeric member, a first electrode wherein the first electrode comprises a plurality of first electrode contact surfaces that extend at least partially around the longitudinal axis of the rail; and a second electrode wherein the second electrode comprises a plurality of second electrode contact surfaces that extend at least partially around the longitudinal axis of the rail; and wherein a second electrode contact surface is positioned in the longitudinal direction between first electrode contact surfaces; and a fixture adapted to be connected electrically to the rail electrodes at a plurality of positions that differ in longitudinal position along the rail and radial orientation around the rail and wherein the fixture comprises a fixture electrical contact configured to connect electrically to a first rail electrode through physical contact with a first electrode contact surface; and keying means for guiding the positioning of the first fixture contact relative to a first electrode electrical contact wherein the keying means includes at least one of a visual indicator and mechanical engagement between portions of the fixture and the rail, wherein the keying means comprises a portion of the polymeric member that is configured to extend a greater distance from the longitudinal axis of the rail than the first electrode contact surface.

5. The electrical distribution system of claim 4, wherein the fixture is configured to surround the rail sufficiently after attachment to provide a mechanical interference hindering removal of the fixture from the rail along paths perpendicular to the longitudinal axis of the rail.

6. The electrical distribution system of claim 4, wherein the rail and fixture are adapted to provide a path of fixture motion comprising a rotation of the fixture about the longitudinal axis of the rail by more than 180 degrees that maintains electrical continuity between the fixture electrical contact and the first electrode.

7. The electrical distribution system of claim 4, wherein the first electrode contact surface forms a helical path around the rail axis adapted to provide a path for fixture movement comprising simultaneous translation of the fixture along the longitudinal axis of the rail and movement of the fixture about the longitudinal axis of the rail by more than 360 degrees that maintains electrical continuity between the fixture electrical contact and the first electrode.

8. The electrical distribution system of claim 7, wherein the fixture is adapted to emit light and wherein the intensity and color of the emitted light is maintained over the path of fixture motion.

9. The electrical distribution system of claim 1, wherein the rail is adapted for bending in directions perpendicular to the longitudinal axis of the rail and wherein the bending moment of the rail is substantially independent of direction perpendicular to the longitudinal axis of the rail.

10. The electrical distribution system of claim 1, wherein the rail further comprises an insulating core.

11. The electrical distribution system of claim 2, wherein the fixture further comprises a spring member that is configured to provide a force pushing against the outer surface of the rail.

12. The electrical distribution system of claim 11, wherein the spring member is configured to contribute contact pressure between a fixture contact and an axially interleaved contact.

13. The electrical distribution system of claim 4, wherein the rail shape is configured to be generally cylindrical characterized by having a substantially uniform radial distance from the rail axis to the position where the fixture electrical contact touches the first electrode contact surface at different longitudinal and radial orientation positions of the fixture.

14. The electrical distribution system of claim 1, wherein the rail further comprises a polymeric member and wherein at least a portion of the polymeric member is configured to be located between portions of adjacent first and second electrodes in the longitudinal direction.

15. An electrical distribution system comprising a rail having a longitudinal axis and an outer surface positioned about the longitudinal axis, said rail including a first electrode wherein the first electrode comprises a plurality of first electrode contact surfaces that extend at least partially around the longitudinal axis of the rail; and a second electrode wherein the second electrode comprises a plurality of second electrode contact surfaces that extend at least partially around the longitudinal axis of the rail; and wherein a second electrode contact surface is positioned in the longitudinal direction between first electrode contact surfaces;

wherein the first electrode and second electrode comprise helical conductors; and a plurality of helical insulating members; and a fixture adapted to be connected electrically to the rail electrodes at a plurality of positions that differ in longitudinal position along the rail and radial orientation around the rail and wherein the fixture comprises a fixture electrical contact configured to connect electrically to a first rail electrode through physical contact with a first electrode contact surface.

16. The electrical distribution system of claim 4, wherein the fixture is capable of being attached to the rail at a plurality of longitudinal positions having the same radial orientation wherein the points of physical contact of the fixture electrical contact with the first electrode contact surface are located in a periodic array parallel to the rail axis and at a radial contact distance from the rail axis, wherein the periodicity is characterized by a first electrode contact axial pitch and wherein the first electrode contact axial pitch is at least 4 times the radial contact distance.

17. The electrical distribution system of claim 16, wherein the first electrode contact axial pitch is greater than one inch.

18. The electrical distribution system of claim 15, wherein the fixture comprises a plurality of separable elements configured for assembly about the rail to an extent sufficient to provide a mechanical interference in directions perpendicular to the rail axis.

19. The electrical distribution system of claim 15, wherein a portion of the first electrode is covered by electrical insulation.

20. The electrical distribution system of claim 19, wherein electrical insulation must be displaced in order for the fixture electrical contact to touch the first electrode contact surface.

21. The electrical distribution system of claim 15, wherein the mechanical attachment of the fixture to the rail comprises magnetic forces.

22. The electrical distribution system of claim 4, wherein the fixture further comprises a solid state light emitter configured to emit light when supplied with electrical power.

23. The electrical distribution system of claim 22, wherein the fixture further comprises a heat sink wherein the heat sink is adapted to remove substantially more of the heat generated by the solid state light emitter than the amount of heat that is removed by thermal conduction to the rail.

24. The electrical distribution system of claim 22, wherein at least one of the color of light emitted or the intensity of light emitted changes if the fixture contacts are attached to a different combination of the axially interleaved contacts.

25. The electrical distribution system of claim 22, having redirection means adapted to change the direction of light emission from the fixture wherein the redirection means includes any combination of bending of the rail, rotation of the fixture around the axis of the rail and translation of the fixture along the axial direction of the rail.

* * * * *